US007166236B2

(12) United States Patent
Sun

(10) Patent No.: US 7,166,236 B2
(45) Date of Patent: Jan. 23, 2007

(54) STAIN-RESIST COMPOSITIONS

(75) Inventor: Yanhui Sun, Wilmington, DE (US)

(73) Assignee: Invista North America S.A.R.L., Wilimington, DE (US)

( * ) Notice: Subject to any disclaimer, the term of this patent is extended or adjusted under 35 U.S.C. 154(b) by 259 days.

(21) Appl. No.: 10/808,814

(22) Filed: Mar. 24, 2004

(65) Prior Publication Data

US 2005/0210599 A1 Sep. 29, 2005

(51) Int. Cl.
*D06M 13/03* (2006.01)
*D06M 13/224* (2006.01)

(52) U.S. Cl. ..... 252/8.62; 8/115.51

(58) Field of Classification Search ..... 8/115.51; 252/8.62

See application file for complete search history.

(56) References Cited

U.S. PATENT DOCUMENTS

| | | | | |
|---|---|---|---|---|
| RE28,475 E | | 7/1975 | Bleck et al. | |
| 4,833,009 A | | 5/1989 | Marshall | |
| 4,937,123 A | | 6/1990 | Chang et al. | |
| 4,940,757 A | | 7/1990 | Moss, III et al. | |
| 4,965,325 A | | 10/1990 | Liss et al. | |
| 5,118,551 A | | 6/1992 | Calcaterra et al. | |
| 5,356,689 A | * | 10/1994 | Pechhold | 428/96 |
| 5,358,769 A | | 10/1994 | Pechhold | |
| 5,707,708 A | * | 1/1998 | Pechhold | 428/96 |
| 5,993,965 A | * | 11/1999 | Flat et al. | 428/375 |
| 6,207,594 B1 | * | 3/2001 | Elgarhy | 442/93 |
| 6,472,476 B1 | * | 10/2002 | Soane et al. | 525/200 |

FOREIGN PATENT DOCUMENTS

| | | |
|---|---|---|
| EP | 306992 | 5/1994 |

* cited by examiner

*Primary Examiner*—Lorna M. Douyon
*Assistant Examiner*—Amina Khan
(74) *Attorney, Agent, or Firm*—Charles E. Krukiel

(57) ABSTRACT

The present invention relates generally to stain-resist compositions, and particularly, but not by way of limitation, to fibers and textiles treated with stain-resist compositions.

2 Claims, No Drawings

STAIN-RESIST COMPOSITIONS

FIELD OF THE INVENTION

The present invention relates generally to stain-resist compositions, and particularly, but not by way of limitation, to fibers and textiles treated with stain-resist compositions. The invention relates more particularly to compositions and methods to impart strong stain resistance after repeated shampooing on polyamide textile substrates.

BACKGROUND

The information provided below is not admitted to be prior art to the present invention, but is provided solely to assist the understanding of the reader.

This invention relates to stain resistant polymeric compositions for the treatment of natural and synthetic fibers. Approximately 75% of all carpet currently produced in the United States, and approximately half of all carpet produced in Europe, is prepared from nylon fiber.

Nylon fiber is relatively inexpensive and offers a combination of desirable qualities such as comfort, warmth, and ease of manufacture into a broad range of colors, patterns and textures. However, nylon, as well as other polyamide fibers and fabrics, is easily stained by certain natural and artificial colorants such as those found in coffee, mustard, wine, and soft drinks.

Fluorochemical coatings have been developed that are effective in protecting carpet from substances such as soil. However, they offer little protection from stains resulting from acid dyes that are found in common household materials such as wine, mustard and soft drinks. Acid dyes are chromophores containing sodium salt of sulfonic acid. The sulfonic acid groups bind the protonated amine ends to the polyamide. A wide variety of methods have been developed to make polyamide fibers or other fibers with terminal amino groups more resistant to staining by acid dyes.

Sulfonated hydroxyaromatic formaldehyde condensate coatings have been disclosed to reduce the staining of polyamide fibers by acid dyes. However, such polymers do not impart resistance to staining by turmeric-containing compounds such as mustard, or by hot coffee. Moreover, ultraviolet light and nitrogen dioxide can yellow such polymers over time. The yellowing can be severe enough to prevent the use of such stain-resist compositions on light shaded textile articles.

Stain-resists based on hydrolyzed copolymers derived from maleic anhydride and ethylenically unsaturated compounds are known. Examples include hydrolyzed copolymers of maleic anhydride with α-olefins. Maleic acid/α-olefin copolymers have been disclosed to impart good anti-staining properties to polyamide substrates. In addition, such polymers resist yellowing. Because of the ionic character of hydrolyzed maleic anhydride copolymer stain-resists, polyamide substrates treated with such stain-resist agents tend to be sensitive to high pH values, which is often encountered in commercial carpet shampoos. Consequently, stain resistance can be partially or completely lost following shampooing. Methacrylic acid homopolymers and copolymers, as well as other carboxylated polymers, are also known as stain-resists. They behave similarly towards polyamide substrates as the hydrolyzed maleic anhydride/α-olefin copolymers.

Compositions based on sulfonated phenol-formaldehyde condensates combined with hydrolyzed maleic anhydride/α-olefin copolymers or polymers of methacrylic acid, when applied to polyamide substrates, provide acid stain resistance and overcome the yellowing caused by UV and/or nitrogen oxides. However, the stain resistance does not survive shampooing, especially at high pH.

U.S. Pat. No. 5,356,689 and U.S. Pat. No. 5,358,769 (Pechhold), assigned to the assignee of the present invention, disclose means to render stain-resist agents less soluble by cross-linking the stain-resist agent to the polyamide fibers. Pechhold discloses co-applying the combined stain-resist agents described above with a water-dispersed epoxy resin or by post-treatment of the stain-resist-treated polyamide fiber substrate with a water-dispersed epoxy resin. The Pechhold process prevents excessive dissolution of the stain-resist agents during alkaline shampoo treatment.

Stain-resist performance of conventional compositions is typically tested by determining the amount of stain imparted by solutions of F&C Red Dye 40, or other acid dyes typically present in beverages and foods. U.S. Pat. No. 5,118,551 (Calcaterra) discloses that most stain-resist agents are ineffective against coffee staining. Calcaterra further discloses that a copolymer selected from the group consisting of hydrolyzed aromatic-containing vinyl ether maleic anhydride copolymers, and half esters of aromatic-containing vinyl ether maleic anhydride copolymers, provided polyamide textiles with stain resistance against coffee. However, stain resistance was lost upon detergent washing at high pH.

Conventional stain-resist agents impart to polyamide substrates resistance against staining by either acid dyes or coffee, but the stain resistance cannot be sustained after repeated shampooing. In addition, none of the stain-resist agents can be used for stain resisting to staining of both acid dyes and hot coffee. Therefore, there exists a need to provide maleic acid/α-olefin stain-resist compositions having both superior resistance to staining by acid dyes and/or coffee and superior resistance to high pH detergent washing.

Other objects and advantages will become apparent from the following disclosure.

SUMMARY OF INVENTION

An aspect of the present invention provides stain-resist compositions with a greater tendency to remain in association with a fabric substrate when treated with shampoos, particularly high pH shampoos. A further aspect provides polyamide fibers and fabrics so treated.

An aspect of the present invention provides compositions and methods that impart to polyamide fabrics resistance against staining by acid dyes, particularly Red Dye 40, and coffee. A further aspect provides polyamide fibers and fabrics treated to resist staining by acid dyes and coffee.

The novel composition provides one or more stain-resist agents in association with a crosslinking agent.

An aspect of the present invention provides stain-resist agents selected from hydrolyzed maleic anhydride/α-olefin copolymers, hydrolyzed maleic anhydride/styrene copolymers, polymethacrylic acid polymers, polymethacrylic acid copolymers, and sulfonated phenol-formaldehyde condensation products.

An aspect of the present invention provides a crosslinking agent. A further aspect provides the crosslinker as a polymer containing at least two hydroxyl groups. The crosslinker may be a hydroxyl-terminated polymer grafted with a maleic anhydride monomer. The crosslinker may contain at least one vinyl group. The crosslinker may be a hydroxyl-terminated, polybutadiene.

An aspect of the present invention provides a stain-resist composition crosslinked to a polyamide substrate wherein the stain-resist composition comprises at least one of a hydrolyzed maleic anhydride/α-olefin copolymer, a hydrolyzed maleic anhydride/styrene copolymer, polymethacrylic acid polymers, polymethacrylic acid copolymers, and sulfonated phenol-formaldehyde condensation products.

A further aspect of the present invention provides a process for imparting resistance to staining by acid dyes to a polyamide substrate, the process comprising applying to said polyamide substrate with a stain-resist composition comprising a crosslinking agent and at least one of a hydrolyzed maleic anhydride/α-olefin copolymer, a hydrolyzed maleic anhydride/styrene copolymer, polymethacrylic acid polymers, polymethacrylic acid copolymers, and a sulfonated phenol-formaldehyde condensation product.

The present invention further relates to an article of manufacture comprising a polyamide substrate in association with a stain-resist composition of the present invention. Along these lines, the present invention relates to a fiber associated with the stain-resist compositions of the present invention. In a further aspect, the fiber is a polymer selected from the group consisting of polyamide, polyester, polyolefin, silk, and wool.

Still other objects and advantages of the present invention will become readily apparent by those skilled in the art from the following detailed description, wherein it is shown and described preferred embodiments of the invention, simply by way of illustration of the best mode contemplated of carrying out the invention. As will be realized the invention is capable of other and different embodiments, and its several details are capable of modifications in various obvious respects, without departing from the invention. Accordingly, the description is to be regarded as illustrative in nature and not as restrictive.

DETAILED DESCRIPTION

The term "fiber" as used herein means a filamentous material generally used in the fabrication of textile and industrial yarns and fabrics, generally characterized by having a length of at least about 100 times its diameter, normally occurring in continuous filament, staple, monofilament, tow, or tape form, and generally suitable for use in the manufacture of floor coverings, upholstery, and apparel.

The term "textile substrate" as used herein means fiber or yarn that has been typically tufted, woven, or otherwise constructed into fabrics suitable for use in home or office furnishings such as floor coverings, upholstery fabric, or the like. Textile substrates comprehended by the invention include polyamide, polyester, polyolefin, and wool.

The term "polyamide" as used herein means the well-known fiber-forming substance that is a long-chain synthetic polyamide. The term particularly relates to poly (ε-caprolactam; "nylon 6") and poly (hexamethylene adipamide; "nylon 6,6") as well as their copolymers.

The term "copolymer" as used herein means any polymer derived from two or more dissimilar monomers.

The term "maleic acid" when used as a part of a copolymer is used equivalently to "maleic anhydride."

In a first embodiment, the crosslinking agent, is emulsified with water by a nonionic detergent. Emulsification of polymer or oligomer is conventional to the art. A suitable detergent is a polyoxyethylene (8) isooctylphenylether sold under the trademark Triton® X-114 (Dow Chemicals). Other suitable detergents include, but are not limited to, polyoxyethylene nonylphenylether sold under the trademark Triton® N-101 (Dow Chemicals). The emulsion is mixed with stain-resist agent in aqueous solution, and then the substrate is immersed into the mixture and heated to boil for about 10–15 minutes. The substrate is then rinsed, centrifuged, and dried at a temperature of about 100°–190° C., thereby providing a polyamide fiber substrate to which the stain-resist agent has been crosslinked.

In a second embodiment, a mixture of stain-resist solution and the emulsified crosslinker is applied to a polyamide substrate by any conventional technique, including techniques that require least amounts of water, such as by padding, Kuster/knife roll, or print roll application. The substrate is then dried at a temperature of about 100°–190° C.

In another embodiment, a mixture of stain-resist solution and the emulsified crosslinker is applied to a polyamide substrate by any of the various exhaustion techniques known to the art.

The present invention relates to compositions of matter useful as stain-resists for fibrous polyamides. The compositions of the present invention are water-soluble or water-dispersible mixtures containing any of hydrolyzed maleic anhydride/α-olefin copolymers, hydrolyzed maleic anhydride/styrene copolymers, polymethacrylic acid polymers, polymethacrylic acid copolymers, and sulfonated phenol-formaldehyde condensation products, or mixtures of the same, as stain-resist agents. Conventional stain-resists are easily removable from treated fabrics by shampoos, particularly shampoo treatments performed at high pH. The present invention greatly improves the shampoo durability by providing crosslinking agents to bind the stain-resist agents to the fabrics.

The crosslinking agent is particularly a polybutadiene functionalized with at least two hydroxyl groups. Although at least two hydroxyl groups need not to be terminally-placed on the polybutadiene, it is preferably that they be spaced apart a substantial fraction of the length of the polymer. In an alternative embodiment, the crosslinker comprises a hydroxyl-functionalized polybutadiene further functionalized with epoxy groups. In a further embodiment, a hydroxyl-functionalized polybutadiene is grafted with a maleic anhydride monomer.

A variety of linear and branched chain alpha-olefins (α-olefin) can be used to form a copolymer with maleic anhydride for the purposes of this invention. Useful alpha-olefins include 1-alkenes, containing 4 to 12 carbon atoms, preferably $C_{4-10}$, such as isobutylene, 1-butene, 1-hexene, 1-octene, 1-decene, and dodecene.

A part of the maleic anhydride (up to 70 mole %) in the copolymer can be replaced by acrylic acid, methacrylic acid, itaconic acid, vinyl sulfonic acid, vinyl phosphonic acid, styrene sulfonic acid, alkyl ($C_{1-4}$) acrylate, alkyl ($C_{1-4}$) methacrylate, vinyl acetate, vinyl chloride, vinylidine chloride, vinyl sulfides, N-vinyl pyrrrolidone, acrylonitrile, acrylamide, and mixtures thereof. In another embodiment, a part (1–75 mole %) of the maleic anhydride can be replaced by maleimide, N-alkyl ($C_{1-4}$) maleimides, N-phenylmaleimide, fumaric acid, crotonic acid, cinnamic acid, alkyl ($C_{1-18}$) esters of the foregoing acids, cycloalkyl ($C_{3-8}$) esters of the foregoing acids, sulfated castor oil, or the like.

The maleic anhydride copolymers useful in the present invention can be prepared according to methods well-known in the art. The maleic anhydride polymers thus obtained can be hydrolyzed to the free acid or their salts by reaction with water or alkali, or they can also be reacted with $C_{1-4}$ alkyl alcohol to provide polymeric alpha-olefin/maleic acid monoesters, which have stainblocking properties. Generally, the hydrolyzed maleic anhydride polymer, or the monoester polymer, should be sufficiently water-soluble that a uniform application to a fibrous polyamide surface can be achieved at an appropriate acidity. However, applications using water dispersions of the polymer mixed with a suitable surfactant may be used to impart stain-resistance.

Preparation of maleic anhydride/alpha-olefin polymers is also described in Reissue U.S. Pat. No. 28,475 and in EP 306992 the disclosures of which are specifically incorporated by reference. These references contain further teaching of techniques for the preparation of such polymers.

The methacrylic polymer in the present invention includes the polymethacrylic acid homopolymer as well as polymers formed from methacrylic acid and one or more other monomers. The monomers useful for copolymerization with the methacrylic acid are monomers having ethylenic unsaturation. Such monomers include, for example, monocarboxylic acids, polycarboxylic acids, and anhydrides; substituted and unsubstituted esters and amides of carboxylic acids and anhydrides; nitriles; vinyl monomers; vinylidene monomers; mono-olefinic and polyolefinic monomers; and heterocyclic monomers.

Representative specific monomers include, for example, acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, alkyl or cycloalkyl esters of the foregoing acids, alkyl or cycloalkyl having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as, for example, acrylamide, methyacrylamide, amd 1,1-dimethylsulfoethylacrylamide, acrylonitrile, methacrylonitrile, styrene, α-methylstyrene, p-hydroxystyrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil, and sulfonated dehydrated castor oil. Particularly useful monomers include, for example, alkyl acrylates having 1–4 carbon atoms, itaconic acid, sodium sulfostyrene, and sulfated castor oil. The mixtures of the monomers, such as, for example, sodium sulfostyrene and styrene, and sulfated castor oil and acrylic acid, can be copolymerized with the methacrylic acid.

The methacrylic polymers suitable for the purposes of the present invention relates to those prepared by polymerizing methacrylic acid, with or without at least one other ethylenically unsaturated monomer described above, in the presence of sulfonated hydroxy-aromatic compound/formaldehyde condensation resins. Those homopolymers and copolymers and their preparation are described in the U.S. Pat. No. 4,940,757, the contents of which are incorporated herein by reference.

The number average molecular weight of the methacrylic polymer should be such that satisfactory stain resistance is provided by the polymer. The number average molecular weight of the polymer is at least 300,000, more preferably in the range of about 350,000 to 800,000.

Crosslinker. The present invention provides that crosslinking agents covalently bind stain-resist agents to the polyamide fibers. An aspect provides that the crosslinker is a polymer terminated by two hydroxyl groups. Another aspect provides that the crosslinker contain at least one vinyl group. Another aspect of the invention provides that the crosslinking agent is a polybutadiene with hydroxyl groups or epoxy/hydroxy groups, or succinic anhydride/hydroxyl groups. A preferred, but non-limiting crosslinker is hydroxyl-functionalized polybutadiene supplied by Aldrich Company, Milwaukee, Wis.

A broad range of water-soluble or water-dispersable polymers are suitable as the crosslinker of the invention, provided that the polymer contains at least two hydroxyl groups. Soluble or emusifiable polymers containing two or more hydroxyl groups, suitable for purposes of the invention may be saturated or unsaturated, aliphatic, cycloaliphatic, aromatic, or heterocyclic. Such polymers include hydroxyl terminated polyethers or polyether copolymers, polyester copolymers, and polyolefins as shown in general formulas I, II, and III.

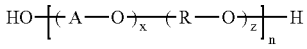

(I)

Wherein A and R can be the same or different. A or R is a $C_1$ to $C_{12}$ alkylene or arylene, or substituted alkylene or arylene; x and z are numbers having average values of one to two hundred; n is an integer having a value of two to ten.

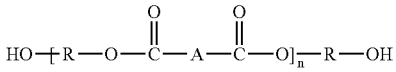

(II)

Wherein A is a $C_1$ to $C_{12}$ alkylene or arylene, or substituted alkylene or arylene; R is a $C_1$ to $C_{10}$ alkylene or arylene, or substituted alkylene or arylene; n is an integer having a value of two to five hundred.

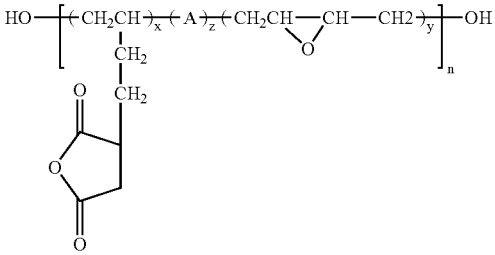

(III)

Wherein A is a $C_1$ to $C_{12}$ alkylene, vinyl ethylene, arylene or alkenylene; x and y are numbers having average values of zero to twenty; z is a number having an average value of five to three hundred; n is an integer having a value of one to three hundred.

In addition, natural cellulose or cellulose derivatives in which hydroxyl groups are on the side chains or on the backbones of the polymer can also be used in the invention as polymeric compositions. However, for sake of convenience and economy, one should generally use commercial polymers with two or more hydroxyl groups. In addition to those described in the Examples herein, which follow, poly (propylene glycol), poly (tetramethylene glycol), poly (1,6-hexamethylene-adipate) diol, and poly (1,4-butanediol adipate) diol can also be used in the invention as the crosslinking agents.

A suitable crosslinking agent is a polybutadiene with hydroxyl groups. Other suitable, non-limiting crosslinkers include hydroxy/succinic anhydride functionalized polybutadiene and hydroxyl/epoxy-functionalized polybutadiene One can blend the crosslinker of the present invention with other known stain-resists, such as phenol-formaldehyde condensation products as disclosed in U.S. Pat. Nos. 4,833,009 and 4,965,325; methacrylic acid polymers disclosed in U.S. Pat. No. 4,937,123; or hydrolyzed polymers of maleic anhydride and one or more ethylenically unsaturated aromatic compounds described in U.S. Pat. No. 5,707,708.

The stain-resist compositions of present invention can be effectively applied to polyamide fibrous substrates by a wide variety of methods known to those skilled in the art, such as: padding, spraying, foaming in conjunction with foaming agents, batch exhaust in beck dyeing equipment, or continuous exhaust during a continuous dyeing operation. They can be applied by such methods to dyed or undyed polyamide textile substrates. In addition, they can be applied to such substrates in the absence or presence of polyfluoroorganic oil, water, and/or soil repellent materials. Polyfluoroorganic repellency materials may be applied to the textile substrate before or after application of the stain-resist compositions of the present invention.

The crosslinking agents of this invention are applied to textile substrates in an amount effective to impart stain-resistance to the substrate. An effective amount of the stain-resist may vary from about 0.5% to about 5% by weight based on the weight of the textile substrate. Generally, an effective amount is about 1% by weight or less. The amount of the crosslinker of this invention needed to improve performance may range between 5% and 100% of the weight of the stain-resist, typically between 10% to 50%. The inventive stain-resist composition can be applied, as is common in the art, at a pH ranging from about 1.5 to about 7. However, effective exhaust deposition can be obtained at a pH as low as 1.5. When the latter low pH is used, the effective level of application to the textile substrate can be about 2.5% by weight, based on the weight of the textile substrate. In an embodiment, a pH between about 2 and 4 is used. Effective stain resistance is obtained where the inventive stain-resist composition is applied to textile substrates at about 20° C. followed by heat treatment at a temperature from about 50° C. to about 150° C. for about 1 to about 60 minutes. In an alternative embodiment, the inventive stain-resist composition is applied at a temperature of from about 40° C. to about 100° C. for a period of from about 1 to 60 minutes. For example, at a pH of about 2 to 4, a temperature of about 70° C. to about 95° C. can be used. An effective stain resistance can be obtained when application is made even at low temperatures, such as from about 10 to 25° C.

Acid Dye Stain Test.

Acid dye stain resistance is evaluated using a procedure modified from the American Association of Textile Chemists and Colorists (AATCC) Method 175-2003, "Stain Resistance: Pile Floor Coverings." 9 wt % of aqueous staining solution is prepared, according to the manufacturer's directions, by mixing cherry-flavored KOOL-AID® powder (Kraft/General Foods, White Plains, N.Y., a powdered drink mix containing, inter alia, FD&C Red No. 40). A carpet sample (4×6-inch) is placed on a flat non-absorbent surface. A hollow plastic 2-inch (5.1 cm) diameter cup is placed tightly over the carpet sample. Twenty ml of the KOOL-AID® staining solution is poured into the cup and the solution is allowed to absorb completely into the carpet sample. The cup is removed and the stained carpet sample is allowed to sit undisturbed for 24 hours. Following incubation, the stained sample is rinsed thoroughly under cold tap water, excess water is removed by centrifugation, and the sample is dried in air. The carpet sample was visually inspected and rated for staining according to the FD&C Red No. 40 Stain Scale described in AATCC Method 175-2003. Stain resistance is measured using a 0–10 scale. Staining of a control polyamide substrate was accorded a value of 0; an undetectable test staining is accorded a value of 10. Ratings are determined by visual examination by a panel of evaluators.

Hot Coffee Stain Test.

A nylon carpet sample (4×6-inch) is placed on a flat non-absorbent surface, and a hollow plastic 2-inch (5.1 cm) diameter cup is placed tightly over the carpet sample. Twenty ml of 2.5 wt % Sanka® coffee solution, heated to 65° C., is poured into the cup. The solution is allowed to absorb completely into the carpet sample, the cup is removed and the stained carpet sample is left undisturbed for 24 hours. The carpet sample is immersed into cold tap water for ten minutes, and rinsed to remove surface staining. One squeeze of liquid detergent is placed on the sample and the stain is scrubbed gently for a half minute. The carpet sample is rinsed thoroughly with cold tap water, the excess water is removed by centrifugation, and the sample is air-dried. The carpet sample is visually inspected and rated for staining according to the FD&C Red No. 40 Stain Scale described in AATCC Method 175-2003. Stain resistance is measured using a 0–10 scale. Staining of a control polyamide substrate was accorded a value of 0; an undetectable test staining is accorded a value of 10. Ratings are determined by visual examination by a panel of evaluators. Alternatively, staining intensity is measured calorimetrically as the delta E number.

Shampoo-Wash Durability Test.

A 4×6-inch nylon carpet sample is submerged for 5 minutes in a detergent solution containing 250 ml 6 wt % of sodium dodecyl sulfate (Duponol® WAQE, Witco Corporation, Greenwich, Conn.) adjusted to pH 10 with sodium phosphate. The specimen is removed from the solution, rinsed in tap water, de-watered by centrifugation, and air-dried. The dried sample is stain tested as above.

The invention will be described in greater detail in conjunction with the following, non-limiting examples.

EXAMPLE 1

Polybd® 605E, a hydroxy/epoxy-functionalized polybutadiene was emulsified by 4 wt % Triton® N101 and 4 wt % Triton® X114 based on the weight of Polybd®605 E in water. The emulsion was mixed with an aqueous solution of maleic acid/octene copolymer and further diluted with water to yield a solution containing 0.33 wt % of stain resist.

The solution was applied to a nylon 6,6 loop carpet of regular acid dye fiber, 28 ounces/square yard, at 300 wt % wet pick-up on the weight of fiber (owf). The treated carpet sample was oven dried at 130° C. The treated carpet sample manifested a stain resistance of 10 (no visible staining on a scale of 1–10), and only slight staining by coffee scale 7. After 1 WAQE wash, the fruit juice stain rating remained at 10; after 2 washes, the stain rating was 9.

EXAMPLE 2

A mixture containing 1.3% (owf) of a maleic acid/octane copolymer, 0.3% (owf) hydroxyl/epoxy-functionalized polybutadiene in emulsion and 1% (owf) of a fluorinated acrylate polymer (BurcoPel® 5556 Burlington Chemical, Burlington, N.C.) was padded onto a nylon 6,6 carpet of regular acid dye fiber, 28 ounces/square yard. The carpet was dried in a 130° C. oven and then subjected to stain testing. The sample was rated 10 for fruit juice and 7 for coffee.

EXAMPLE 3

A 4×6-inch nylon 6,6 loop carpet of regular acid dye fiber, 28 ounces/square yard, was placed in a beaker containing 450 grams water, 0.12 grams maleic acid/octane copolymer, and 0.12 grams hydroxyl/epoxy-functionalized polybutadiene emulsion. The mixture was heated to boiling for 15 minutes. The carpet was rinsed and dried in a 130° C. oven and subjected to stain testing. The sample was rated 10 for fruit drink stain and 7.5 for coffee.

EXAMPLE 4

An 8×12-inch nylon 6,6 loop carpet of deep acid dye fiber, 28 ounces/square yard, was dyed into off-white color. The sample was placed in a tray containing 1500 grams of water, 0.588 grams of polymethacrylic acid with ~350,000 molecular weight, and 0.318 grams of hydroxy/epoxy polybutadiene emulsion in 37 wt % solid content. The mixture was heated and allowed to boil for 10 min. Thereafter, a sufficient amount of a sulfamic acid solution was added to adjust the mixture pH to about 3. The mixture was boiled for a further 10 minutes. The sample was then rinsed and dried in a 130° C. oven to dryness. The sample was cut into pieces for fruit drink stain test, coffee stain test, and WAQE wash durability test. The tested results are shown in Table 1.

TABLE 1

Stain Test Results on Deep Acid Dye Carpet

| Sample # | Color | Treatment | WAQE | Fruit Drink Stain Rating* | Coffee Stain Rating* | Delta E of Coffee Test Sample |
|---|---|---|---|---|---|---|
| Control | Off-white | No | | 1.0 | 2.0 | 23.56 |
| Control-2** | Off-white | Yes | | 9.0 | 7.0 | 9.83 |
| Control-2** | Off-white | Yes | 1x | 4.0 | 5.0 | 13.65 |
| Example 4 | Off-white | Yes | | 10.0 | 8.0 | |
| Example 4 | Off-white | Yes | 1x | 7.5 | 7.0 | |
| Example 4 | Off-white | Yes | 2x | 7.0 | 7.0 | |
| Example 4 | Off-white | Yes | 3x | 7.5 | 7.0 | |

*An average of three people's rating. 10 means no stain at all,
**The sample was treated with polymethacrylic acid alone. No crosslinker was used.

EXAMPLE 5

Hydroxyl terminated polybutadiene (Aldrich Co.) was emulsified by 9.6 wt % Triton® 114 in deionized water. An 8×12 square inch nylon 6,6 loop carpet of regular acid dye fiber, 32 ounces/square yard, was dyed into beige color and was placed in a tray containing 1500 grams of water, 0.74 grams of polymethacrylic acid with ~350,000 molecular weight, 0.074 grams of maleic acid/octene copolymer, and 0.537 grams of hydroxyl terminated polybutadiene emulsion in 41.2 wt % solid content. The mixture was heated and allowed to boil for 10 min. Thereafter, a sufficient amount of a sulfamic acid solution was added to adjust the mixture pH to about 3. The mixture was boiled for a further 10 minutes. The samples was then rinsed and dried in a 130° C. oven to dryness. The sample was cut into pieces for fruit drink stain test, coffee stain test, and WAQE wash durability test. The tested results are shown in Table 2.

TABLE 2

Stain Test Results on Regular Acid Dye Carpet

| Sample # | Color | Treatment | WAQE | Fruit Drink Stain Rating* | Coffee Stain Rating* | Delta E of Coffee Test Sample |
|---|---|---|---|---|---|---|
| Control | Beige | No | | 2.0 | 3.8 | 13.91 |
| Control | Beige | No | | 2.0 | 4.0 | 14.20 |
| Control-2** | Beige | Yes | | 9.0 | 7.0 | |
| Control-2** | Beige | Yes | | 9.5 | 7.5 | |
| Control-2** | Beige | Yes | 1x | 3.8 | 4.5 | |
| Control-2** | Beige | Yes | 1x | 4.0 | 5.0 | |
| Example 5 | Beige | Yes | | 10.0 | 10.0 | 3.68 |
| Example 5 | Beige | Yes | | 10.0 | 10.0 | 3.85 |
| Example 5 | Beige | Yes | 1x | 7.3 | 9.5 | 3.92 |
| Example 5 | Beige | Yes | 1x | 7.3 | 9.5 | 4.09 |
| Example 5 | Beige | Yes | 2x | 8.5 | 8.0 | |
| Example 5 | Beige | Yes | 2x | 8.5 | 7.8 | |

*An average of three people's ratings. 10 means no stain at all, and 1 indicates a sever stain. A duplicate sample was tested.
**The sample was treated with polymethacrylic acid and maleic acid/octene copolymer only. No crosslinker was used.

EXAMPLE 6

An 8×6-inch nylon 6,6 loop carpet of deep dye fiber, 28 ounces/square yard, was dyed into off-white color. The sample was placed in a tray containing 700 grams of water, 0.264 grams of polymethacrylic acid with ~350,000 molecular weight, and 0.185 grams of emulsion of hydroxyl terminated polybutadiene, grafted with maleic anhydride, in 42.8 wt % solid content. The mixture was heated and allowed to boil for 10 minutes. Thereafter, sufficient sulfamic acid solution was added to adjust the mixture pH to about 3. The mixture was boiled for a further 10 minutes. The sample was then rinsed and dried in a 130° C. oven. The sample had a rating of 10 for fruit drink stain and 8 for coffee stain.

The invention claimed is:

1. A stain-resist composition comprising:

a crosslinking agent comprising at least one polymer having two hydroxyl groups: and a stain-resist agent comprising at least one polymer, wherein said crosslinking agent is a hydroxyl terminated polybutadiene grafted with maleic anhydride.

2. A process for imparting resistance to staining by coffee and/or acid dyes to a polyamide substrate, the process comprising contacting said polyamide substrate with a stain-resist composition comprising:

a crosslinking agent comprising at least one polymer having at least two hydroxyl groups; and a stain-resist agent comprising at least one polymer, wherein said crosslinking agent is a hydroxyl terminated polybutadiene grafted with maleic anhydride.

* * * * *